United States Patent [19]

Gebhard

[11] 4,091,965

[45] May 30, 1978

[54] COMBINED FEEDING SPOUT AND CAP ATTACHMENT

[75] Inventor: Albert W. Gebhard, Boulder, Colo.

[73] Assignee: Gerico, Inc., Boulder, Colo.

[21] Appl. No.: 698,358

[22] Filed: Jun. 22, 1976

[51] Int. Cl.[2] ..... B65D 47/26

[52] U.S. Cl. ..... 222/192; 222/512; 222/548

[58] Field of Search ..... 222/561, 555, 91, 531, 222/528, 553, 512, 191, 192, 548, 512

[56] References Cited

U.S. PATENT DOCUMENTS

| | | | |
|---|---|---|---|
| 2,585,373 | 2/1952 | Dickerman et al. | 222/555 |
| 2,971,680 | 2/1961 | Wilson et al. | 222/512 |
| 3,104,032 | 9/1963 | Hansen | 222/91 |
| 3,104,039 | 9/1963 | Dike | 222/548 |
| 3,447,724 | 6/1969 | Fiddyment | 222/561 X |

*Primary Examiner*—Robert B. Reeves
*Assistant Examiner*—David A. Scherbel
*Attorney, Agent, or Firm*—John E. Reilly

[57] ABSTRACT

A container for flowable materials such as baby food and the like has a circular shaped enclosing cap with a port opening into the interior of the container. A cover having an elongated hollow extension terminating in a feeder or dispenser portion releasably engages the circular cap so that the hollow extension can be rotatably aligned with the cap port thereby allowing transfer of flowable materials from the container into the feeder portion by gravity, flexure of the container or both. The cover is rotatable on the circular cap so as to control the amount of opening alignment with the cap port between a fully open and fully sealing closure position. The cover and cap can include cooperating stops for facilitating alignment and closure. An O-ring in surrounding relation to the cap port provides additional sealing.

16 Claims, 9 Drawing Figures

COMBINED FEEDING SPOUT AND CAP ATTACHMENT

BACKGROUND OF THE INVENTION

The present invention relates to devices and means for selectably transferring flowable materials from a container. More particularly, the present invention relates to apparatus for controlled dispensing of flowable materials from a container into a receptacle suitable for infant feeding or similar operations. The present invention is especially useful for controlled metering of semi-liquid or otherwise flowable materials such as prepared baby food so that it is handily available for use or consumption while permitting selectable control of the amount of such dispensing as well as potential sealed closure of the container when not in use.

The feeding of infants so that the foodstuffs are conserved despite the hazards of unpredictable actions of the intended recipient has been a problem for some time. One approach for dispensing liquid materials such as milk, juices and the like is by means of a nippled container as is well known. However, such devices are not well suited for semi-liquid or flowable materials such as prepared baby foods.

There have been several arrangements suggested for direct container dispensing of such semi-liquid material. For instance, use of an elongated hollow extension in place of a nipple for a feeding bottle has been suggested in U.S. Pat. Nos. 2,953,170 by Bush, 3,071,272 by Doner and 3,104,032 by Hansen. Doner employs a threaded replacement cap so that either a nipple or the hollow elongated extension terminating in a spoonlike bowl can be attached. Hansen employs the elongated spoon-like extension for puncturing a seal on a collapsible container. Bush suggests a collar retained spoon-like extension for a squeezable feeding bottle wherein the extension can be inverted into the bottle for storage in conjunction with a separate sealing cap. None of these devices suggests an arrangement wherein the container can be selectably valved into an open or feeding relation or closed in a completely sealed relation with a self-contained apparatus.

It has also been known to configure dispensers for flowable materials by use of a fixed cap with an offset opening and a rotatable cover with an opening that can be aligned with the cap opening for dispensing or out of alignment for sealing. Such devices are popular for such items as grated cheeses, spices, dehydrated products and the like. The rotatable cover is typically a disc held in place over the container cap by a molded collar. Although suitable for throw-away dry material dispensers, such devices do not provide adequate sealing for liquid or semi-liquid materials. Further, such devices cannot be assembled and disassembled for cleaning as is mandatory for infant feeding usage.

There has been a continuing need for an apparatus capable of dispensing flowable materials including liquids or semi-liquids from a container by use of apparatus which minimizes potential loss of the container contents while still permitting easy and selectable opening of the container contents for metering or dispensing and complete sealing of the container for storage when not in use. Furthermore, there is a continuing need for such a device which is completely self-contained so that hazards of loss of the essential components is minimized and the need for additional sealing components avoided. Still further, there has been a continuing need for such a device which can be easily assembled and disassembled from components susceptible of manufacture from low cost techniques but which are amenable to effective and through cleaning when disassembled.

SUMMARY OF THE INVENTION

The present invention makes it possible to selectably permit the discharge of flowable materials from a container by an attachment which requires minimal cooperatively interrelated components which can be easily manufactured employing low-cost techniques and materials. With the components assembled in place on a container, the attachment is self-contained and can be held and manipulated with one hand so that sealing or dispensing can be obtained with simple rotary movement of the elements. However, the components involved can be easily disassembled for through and complete cleaning.

The attachment in accordance with this invention includes a cap attached to or integrally formed with the container and having a circular rim surrounding a flat surface. A hole or bore passes through this flat surface of the cap in offset relation to the center of the circular rim with the hole being in open communication with the interior of the container. A cover which has a circular ridge surrounding a flat surface is adapted to engage the rim of the cap so that the two flat surfaces are maintained in a parallel but rotatable relation. This cover likewise includes an opening through its flat surface in offset relation to the center of the cover ridge for alignment with the hole in the cap in at least one rotational position between the flat surfaces of the cap and the cover. Sealing around the hole through the cap and isolation of the feed channels can be enhanced by including a circular ring such as an O-ring or the like on the cap so as to interface with the cover. Stops can also be included on the cover and the cap to facilitate open and closed alignment of the holes through the cap and cover. An extension spout on the cover which terminates in a spoon-like bowl or feeder portion can be included to facilitate feeding of flowable materials which is particularly useful for feeding of prepared food products to infants.

It is therefore an object of this invention to provide a novel and improved apparatus for selectably valving an opening into a flowable material container.

Another object of this invention is to provide a novel and improved porting or valve arrangement in spoon feeders and the like for allowing selectable dispensing or sealing of a flowable material from a container; and further wherein the component's thereof facilitate handling and feeding of infants in a more convenient manner.

A further object of this invention is to provide a novel and improved apparatus for selectably dispensing or sealing a flowable material from a container in an arrangement which requires a minimal number of components in an easily assembled and disassembled self-contained configuration and which is economical to manufacture.

The foregoing and other objects, advantages and features of the present invention will be more readily apparent in view of the following detailed description of an exemplary embodiment.

DETAILED DESCRIPTION OF THE PREFERRED EMBODIMENT

Figure 1:
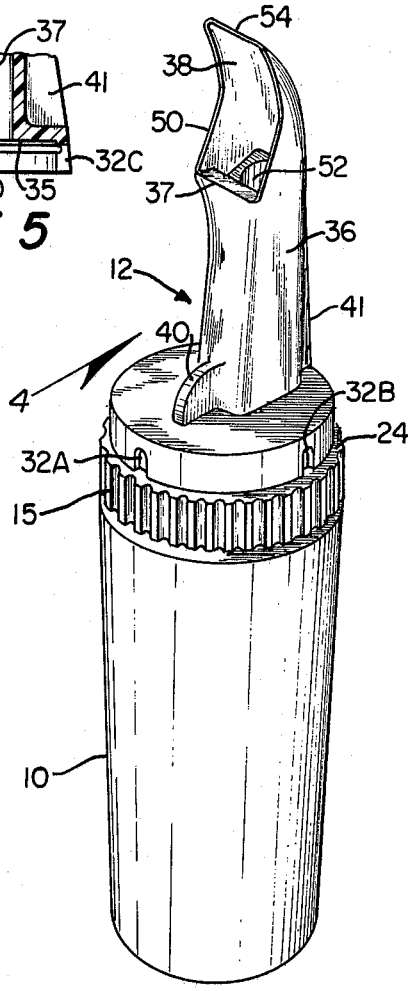
FIG. 1 is a perspective view of a container with a self-contained adaptor attached thereto in accordance with the present invention.

FIG. 1 is a perspective view of a generally cylindrical container 10 which has a feeding spout assembly 12 attached thereto in accordance with the present invention. Preferably container 10 is configured somewhat like a conventional baby feeding bottle and is fabricated from a thin-walled flexible material which permits manual control of the dispensing of the contents in container 10 through spout assembly 12. The primary utility envisioned by this invention is for the controlled dispensing of semi-liquid materials such as the somewhat mushy prepared baby food products but the invention is also useful for dispensing liquids or other flowable materials.

Figure 2:
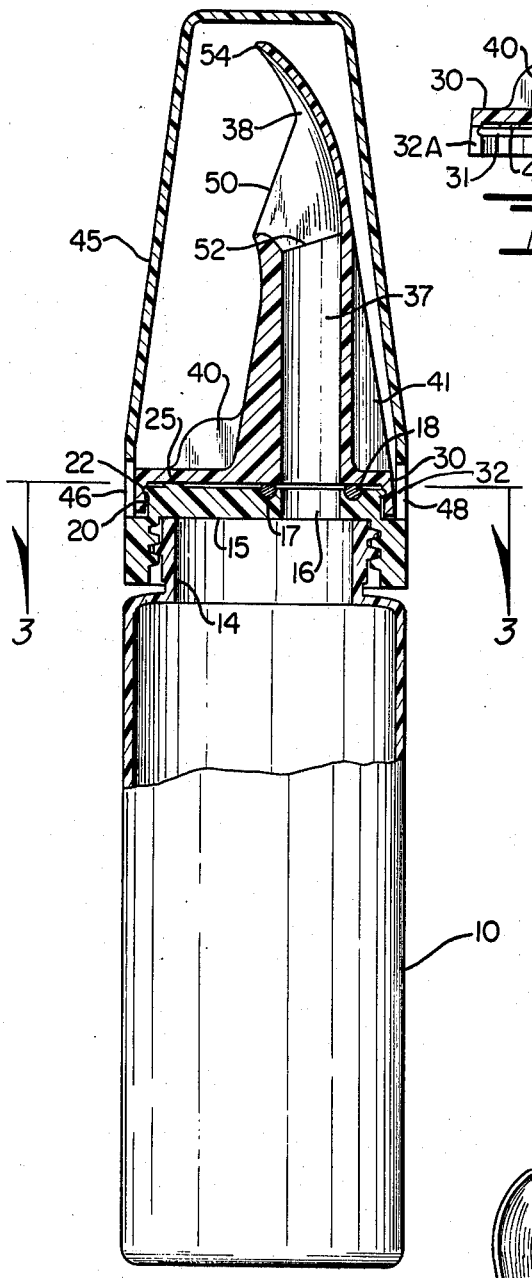
FIG. 2 is a partially broken and sectioned view of the FIG. 1 embodiment including a protective cup.
Figure 3:
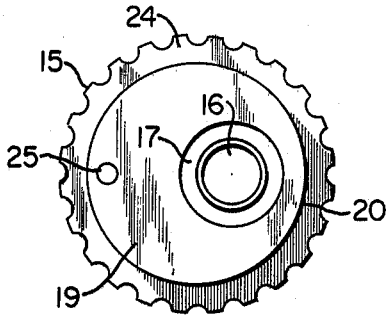
FIG. 3 is a top plan view of the container cap for FIGS. 1 and 2.

As best seen in the partially broken and section view of FIG. 2, container 10 includes an upper neck portion 14 which is threaded for receiving a cap 15, the latter being shown in top plan view in FIG. 3. Cap 15 is formed in a generally circular configuration with a serrated outer circumferential surface as shown to facilitate gripping for attachment or detachment of cap 15 on neck 14. Cap 15 includes a port 16 which opens therethrough from the upper flat surface 19 and communicates with the interior of container 10. Surrounding port 16 is an annular groove 17 for receiving a sealing O-ring 18 shown in section in FIG. 2. Cap 15 includes a circular shoulder or rim 20 which further has formed thereon an outwardly extending annular lip or ridge 22. Further, a stop shoulder or post 25 extends upwardly from the top flat surface 19 of cap 15.

Figure 5:
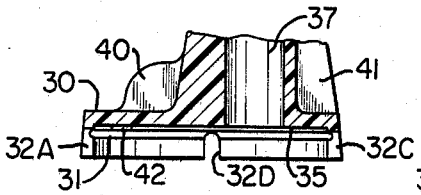
FIG. 5 is a section view of a portion of the spout attachment.
Figure 4:
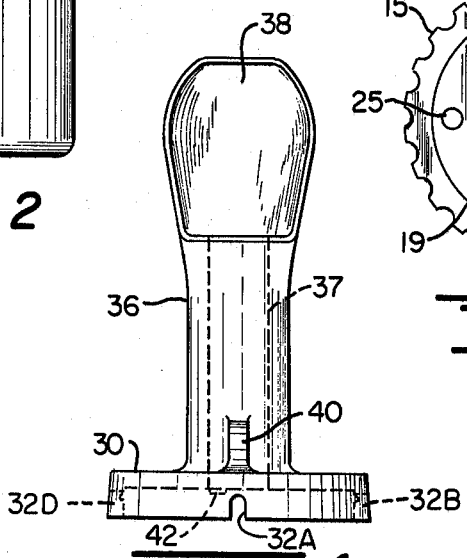
FIG. 4 is a plan view of a spoon-like spout attachment for the FIG. 1 embodiment.

A cover 30 is likewise formed as a circular member and, as shown in section in FIG. 5, includes an outer rim 32 having an inner annular groove or channel 31 for receiving the ridge or lip 22 of cap 15 as best seen in FIG. 2. By forming a series of quadrantly located notches such as 32A–32D visible in FIGS. 1, 4 and 5, the resiliency of cover 30 is enhanced to facilitate snap-on placement of cover 30 over cap 15. Therefore, the generally circular flat surface 35 of cover 30 and the similar circular flat surface 19 of cap 15 are retained in parallel interfacing relation but rotary motion between the flat surfaces of cap 15 and cover 30 is permitted.

Extending from cover 30 is an elongated hollow spout 36 which has a central open passage 37 therein terminating at a point on flat surface 35 in offset relation to the central axis thereof. The hollow elongated neck 36 terminates in a spoon-like bowl 38. As shown, reinforcing ribs such as 40 and 41 can be included to facilitate manual rotary movement of the spout and cover 30 if desired although the inclusion of such ribs is not mandatory since the outer edge of cover 30 can be grasped for rotary motion.

The cover 30 includes a stub 42 extending from flat surface 35 [note FIG. 5] with this stub being positioned to engage post 25 when the central passage 37 of neck 36 is in full alignment with port 16 of cap 15. Although not shown, it will be recognized that an additional stop on cap 15 somewhat similar to post 25 can be included to engage stub 42 when the neck assembly and cover 30 have been rotated so that passage 37 is fully displaced from alignment with port 16 thereby effecting a closing seal of the container 10. By using an O-ring 18 of a greater diameter than the space between the bottom of annular groove 17 and the bottom flat surface 35 of cover 30, assembly of cover 20 onto cap 15 will slightly squeeze O-ring 18 to effect a sliding interface seal. Thus, the space between surfaces 35 and 19 will be isolated from any material migration during passage of such materials from container 10 through port 16, and passageway 37 to the open spoon-like bowl 38 during feeding. Note that post 25 and/or stub 42 can be dimensioned to provide an additional sliding support between the flat surfaces 19 and 35 so as to reduce any tendency for rocking movement between cap 15 and cover 30.

Cap 15 includes an additional circular shoulder 24 which is dimensioned for receiving a protective cup 45 shown in section view in FIG. 2. To facilitate frictional engagement of the opening of cup 45 onto the outer rim of cover 30 and into abutting relation with shoulder 24, a series of circumferential notches such as 46 and 48 can be included to increase the circumferential resiliency of cup 45. Preferably post 25 and stub 42 are located such that rotary movement of cover 30 in the same direction that cap 15 is threaded onto container 10 will result in sealing of the attachment 12 (i.e.: port 16 and passageway 37 fully out of alignment). Open and close direction indicating arrows can be formed or otherwise inscribed on the exterior of the container or attachment as an aid for the user.

Figure 6:
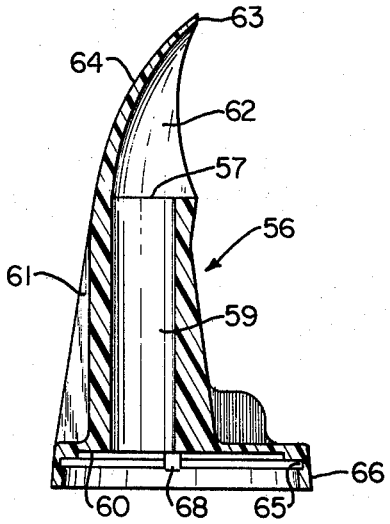
FIG. 6 is a section view of another snap-on spout configuration.
Figure 8:
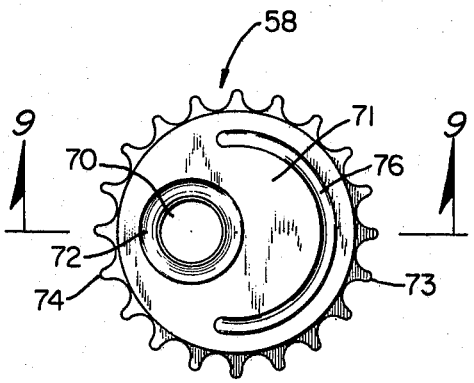
FIG. 8 is a top view of a container cap adapted for the FIG. 6 spout attachment.
Figure 7:
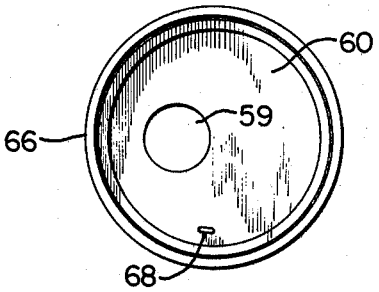
FIG. 7 is a bottom view of the FIG. 6 attachment.
Figure 9:
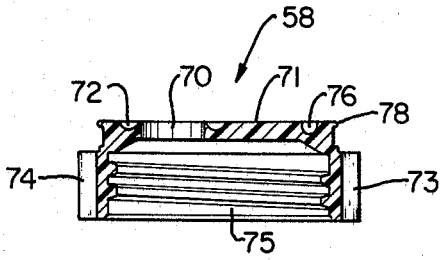
FIG. 9 is a section view taken along line 9—9 of FIG. 8.

Another embodiment particularly advantageous for maintaining minimum spacing between the spout cover 56 and container cap 58 is shown in FIGS. 6–9. FIG. 6 is a section view of spout cover 56 which is generally similar to spout cover 30 in that a central passageway 59 extends from bottom surface 60 through neck 61 and opens into bowl 62 formed by gently curved and contoured terminating sidewall 64. Bottom surface 60 is slightly above a circular groove 65 at the upper portion of downwardly extending circumferential rim 66. Note that rim 66 is circumferentially continuous without notches in this embodiment since, by forming spout cover 56 and cap 58 of FDA acceptable grade general purpose polypropylene, sufficient resiliency is available for secure but easy assembly of cover 56 onto cap 58. Finally, cover 56 includes a post 68 extending downwardly from surface 60 as is shown.

Cap 58 is somewhat similar to cap 15 described hereinbefore in that it includes a port 70 extending therethrough in offset relation to the central axis of cap 58 but rotatably alignable with passageway 59 of spout 56. Furthermore, an annular groove 72 surrounds the opening of port 70 on upper surface 71 for accepting a resilient sealing O-ring (not shown). Cap 58 has a plurality of wing-like projections such as 73 and 74 to facilitate manual gripping and is internally threaded in interior portion 75 (note FIG. 9) for attachment to a container. A semi-circular channel 76 extends into cap 58 from surface 71 and is positioned to internally receive post 68 when spout 56 is snapped over cap 58 so that radial ridge 78 is retained within receiving groove 65. By positioning post 68 and channel 76 so that they are oriented radially outside of O-ring groove 72 but within the outer perimeter of surface 71, spout cover 56 and cap 58 can be assembled only when port 68 aligns with channel 76 but, once snap-on assembled, provide fully open and fully closed stops while maintaining minimum separation between surfaces 60 and 71 thereby minimizing prospects of material migration into this spacing.

It will be recognized that the stop arrangement to locate the passage alignment and closure positions can be implemented by means other than the specific examples shown. For instance, a nub and detent hole or holes arrangement could be used or additional stop bar means included as mentioned for full alignment and full closure positions. Note also that the stub 42 on cover 30 can engage O-ring 18 to effect the fully closed position indication. The stub or post 25 can be formed as a partial circumferential segment to engage stub 42 on its respective ends to define the fully open and fully closed positions. Although a circumferential ridge and groove arrangement as shown at 22 and 31 insures axial alignment and proper retention between cap 15 and cover 30, a simple frictional engagement could be satisfactory for some purposes. It should be recognized that cap 15 could be formed as an integral part of container 10 if desired although the preferred embodiment shown is particularly advantageous in that it adapts to existing container configurations.

In a typical configuration particularly well-suited for infant feeding, container 10 is formed by blow molding or injection blow molding with 0.050 inch sidewalls of FDA acceptable grade low density polythethylene or polypropylene. This flexible thin-walled structure for container 10 is particularly advantageous for paste-like products since such products inhibit introduction of air into the container as is needed to support pure gravity flow. Note that release of collapsing pressure on container 10 will effect withdrawal of any materials in passages 37 or 59 so as to substantially clear it. Caps 15 and 58 and covers 30 and 56 including spoon spouts 36 and 61 are preferably injection molded of FDA acceptable grade general purpose polypropylene which is durable, fairly rigid and substantially shatterproof. Cap 15 has a radial thickness of about 0.4 inches at the serrated edges, a total height of 0.650 inches of which the serrated edge extends 0.450 inches, and the O.D. of flat surface 19 is 1.450 inches with ridge 22 having a 0.050 inch square cross-section. Hole 16 is of 0.50 inch diameter and located with the center thereof offset from the central axis by 0.30 inches. Annular groove 17 is 0.051 inches deep to accept an O-ring 18 of a 0.103 inch diameter cross-section. O-ring 18 is typically of FDA grade rubber, silicone, buna-N or like materials. Cover 30 is 0.110 inches thick at the circular portion above flat surface 35, is about 0.30 inches high at the outer rim, and has four quadrantly located notches such as 32A–32D formed 0.125 inches wide and about 0.150 inches high. Annular groove 31 is 0.50 inches square in cross-section to receive rib 22 of cap 15 with the top of groove 31 being located 0.040 inches below flat surface 35. Thus, since about 0.051 inches of O-ring 18 extends above flat surface 19, snap-on attachment of cover 30 onto cap 15 effects a compressive seal against O-ring 18 between surfaces 19 and 35. Additionally, by forming stop post 25 with a 0.0625 inch radius at a location 0.625 inches from the center of circular surface 19 and with a height of 0.040 inches, post 25 provides a sliding support for cover 30 against surface 35. Stub 42 is likewise formed with a 0.040 inch height for a similar reason but is offset from axial alignment by 0.0625 inches (the radius of post 25) so that hole 16 and passage 37 are in alignment when stub 42 abuts post 25. Of course, passageway 37 is of a 0.5 inch diameter offset from the center of surface 35 by 0.3 inches for alignment with hole 16.

Spout 36 is typically 3.0 inches high and 0.75 inches at the stem although bowl 38 is preferably 1.0 inches wide and 1.5 inches long with a depth tapering from about 0.8 inches at the outer end of passage 37 to the outer edge of bowl 38 which preferably curves upwardly toward the outer edge as shown to facilitate feeding.

The configuration of the spoon-like bowl termination 38 or 62 for spout extension 36 or 61 shown in FIGS. 1, 2, 4 and 6 is particularly advantageous for feeding prepared foods to infants. Thus bowl 38 or 62 is formed with a sidewall 50 or 64 of a generally U-shaped cross-section so that opening 52 or 57 of passage 37 or 59 is below the open portion of sidewall 50 or 64 at the point of entry into the cavity of the bowl. The sidewalls extend outwardly with a diminishing depth so as to from the receiving cavity of bowl 38 or 62. This permits gradual feeding of liquid from container 10 into the cavity of the bowl when the entire assembly is held generally horizontal with the bowl facing upwardly. The cavity of the bowl will fill with the liquid until opening 52 or 57 is completely covered at which point flow will stop until some of the liquid is removed from bowl 38 or 62. Further, sidewalls 50 or 64 continue in an upwardly curved somewhat shovel-like extension lip 54 or 63 so that semi-liquid materials disgorged from opening 52 or 57 into the cavity of the bowl will be channeled onto lip 54 or 63 as is particularly useful for infant feeding. However, it will be recognized that other configurations of the terminal end of the spout can be used such as by continuing the sidewalls generally parallel to the axis of the passageway in a somewhat more conventional spoon-bowl arrangement as might be useful for adult feeding.

In use, the container 10 is charged with the materials to be metered for feeding and cap 15 or 58 is threaded thereon. The cover 30 or 56 is snapped into place on cap 5 or 58 with the O-ring effecting passageway sealing. Rotary movement of cover 30 or 56 relative to cap 15 or 58 until the stop (post 25 and stub 42 or post 68 in channel 76 engage) indicates to the user that the port 16 or 70 and internal passage 37 or 59 of neck 36 or 61 are in alignment. The contents of container 10 can then be introduced to the spoon bowl by gravity and/or squeezing of container 10 and thus be made available for infant feeding or such operations. When it is desired to close the container as for storage, the device is inverted and any pressure on container 10 released so that the contents of passage 37 or 59 are returned to the interior of container 10. The spout cover can then be rotated relative to the cap so that the passage openings and ports are completely out of alignment and thus the interior of container 10 is sealed via the closing relation of O-ring. Protective cup 45 can then be added if desired.

Although the present invention has been described with particularity relative to the foregoing detailed description of an exemplary preferred embodiment, various modifications, additions, changes and applications other than those specifically mentioned herein will be readily apparent to those having normal skill in the art without departing from the spirit of this invention.

What is claimed is:

1. In apparatus for selectably controlling the discharge of flowable material from an open end of a container comprising:

a cap member adapted to be secured to the open end of the container and having a flat surface on one end thereof with a first rim surrounding said flat surface and with a port through said flat surface, said port being in open communication with the interior of the container, a cover member mountable on said cap member in close mating relation thereto, said cover member having a flat smooth surface and a second rim surrounding said flat smooth surface, said first and second rims adapted for positive yielding engagement with one another so that said flat surface and said flat smooth surface are maintained in closely spaced parallel relation to one another, said cover member having an opening through the flat surface of said cover member movable into and out of alignment with the port in said cap member by relative movement of said flat surface and said flat smooth surface, an elongated hollow spout having a pair of open ends with a first said end forming a direct extension from said cover member in a direction away from the container, mounting means on said first and second rims for retaining said cap member and said cover member in said close mating relation to one another, said mounting means including a circular lip on one of said rims and a channel on the other of said rims, said channel positively receiving said lip when said cover member is mounted on said cap member, and annular resilient sealing means between said flat surface and said flat smooth surface, said sealing means received by a groove in one of said flat surface and said flat smooth surface for retention thereby and biased against the other of said surfaces, said sealing means disposed in surrounding relation to said port and said opening when said opening is aligned with said port, said sealing means cooperating with said lip and said channel to maintain the closely spaced relation of said flat surface and said flat smooth surface.

2. In apparatus in accordance with claim 1, said sealing means being defined by a circular ring.

3. In apparatus in accordance with claim 1, said cover member and said cap member being relatively rotatable to control alignment between said opening and said port, and rotary limit stop means for preventing continued rotary motion in a first direction when said port and said opening are in alignment for passage of flowable materials therethrough.

4. In apparatus in accordance with claim 3, said stop means further including means for blocking rotary motion between said flat surfaces in a direction opposite said first direction when said port and said opening are out of alignment for externally isolating the interior of the container.

5. Apparatus in accordance with claim 1 wherein the second one of said spout ends is in an open bowl configuration for receiving flowable materials transferred from the container through said port, said opening and the hollow interior of said spout.

6. Apparatus in accordance with claim 5 wherein said spout includes an elongated neck having an open passage through the length thereof terminating in said pair of open ends, said bowl configuration including a sidewall of a generally U-shaped cross-section opening away from said second with said sidewall being attached to said neck in surrounding relation to said second of said open ends with said sidewall converging so as to form a spoon-like cavity of decreasing depth towards the ends of said bowl furthest from said flat surface.

7. Apparatus for selectably storing or discharging flowable materials comprising:

a hollow container having an open end on one end thereof;

a cap member securable to said open end in sealing relation thereto and having a flat surface with a port through said flat surface, said port being in open communication with the interior of the container;

a cover member having a recessed portion for receiving the flat surface of said cap member in close mating relation, the interior end of said recessed portion being a flat smooth surface with an opening therethrough;

channel and lip means between said flat surface and said recessed portion for securing said cover member to said cap member in rotatable relation so that said flat surface and said flat smooth surface are in closely spaced parallel relation to one another, said port and said opening advancing into and out of alignment with one another when said cover member is rotated with respect to said cap member, said recessed portion having a resilient sidewall forcing said channel and lips means into engagement;

stop means including a nub between said flat surface and said flat smooth surface for preventing rotation of said cover member and said cap member when said opening and said port are aligned;

an elongated hollow spout attached at one end to said cover member opposite said recessed portion and in communication with said opening, the other end of said spout being formed in a bowl open to the interior of said spout with said bowl further opening in a direction facing the central axis through said cover member; and a resilient sealing ring between said flat surface and said flat smooth surface and surrounding said port in fixed relation thereto and biased against said flat smooth surface for confining the flowable materials for passage through said port and said opening, said nub and said sealing ring cooperating with said channel and said lip to maintain the spaced parallel relation between said flat surface and said flat smooth surface.

8. Apparatus in accordance with claim 7 which includes a resilient O-ring attached on said enclosure flat surface in surrounding relation to said port, said O-ring being dimensioned for compressive engagement by said cover flat surface when said cover is attached to said enclosure.

9. Apparatus in accordance with claim 7 wherein said cover member is formed in a radially flexible configuration for snap-on engagement with said cap member and further including a plurality of notches formed in the sidewall of said recessed portion.

10. Apparatus in accordance with claim 7 wherein said container includes a neck portion for securely attaching said cap member thereto, said container having flexible sidewalls yieldingly movable for urging flowable materials in said container through the aligned said port and said opening into said spout.

11. Apparatus in accordance with claim 7 wherein said spout includes an elongated central portion having an open passage through the length thereof with one end of said passage opening through said flat smooth surface, the other end of said passage opening into said bowl, said bowl being formed of a wall of generally U-shaped cross-section attached to said central portion so that said passage open end is positioned completely below the open portion of said bowl cross-section, said bowl wall converging towards the central axis through said cover member so that said bowl has a U-shaped cross-section of gradually decreasing depth in the direction towards the end of said bowl furthest from said flat surface.

12. Apparatus in accordance with claim 11 wherein said wall of said bowl is formed so as to define a cavity which will be filled by liquid transferred from said container so as to block said spout central portion passage when said container is held so that the central axis thereof is generally horizontal while said bowl is oriented to open in a generally upward vertical facing relation.

13. Apparatus in accordance with claim 12 wherein said wall of said bowl continues in a lip extending beyond said bowl cavity along the edge opposite said other end of said spout central passage, said lip forming a surface curving above the open portion of said bowl cavity for providing a shovel-like terminal end of said spout.

14. Apparatus in accordance with claim 7 wherein said stop means is formed by a post extending from said flat surface, said nub extending from said flat smooth surface with said post and said nub being in equal radial spacing from the axis of said cap member and said cover member, respectively.

15. Apparatus in accordance with claim 7 wherein said nub is attached to said flat smooth surface and said stop means includes an elongated channel in said flat surface on the side opposite said container interior for internally receiving said nub, said channel being formed as a segment of an arc with a radial spacing relative to the axis of said cap member equal to the radial spacing of said nub relative to the axis of said cover member, said nub being constrained to movement within said channel.

16. Apparatus in accordance with claim 15 wherein engagement of said nub with a first end of said channel is effected when said port and said bore are fully in alignment and said nub engages the opposite end of said channel when said port and said bore are fully out of alignment.

* * * * *

UNITED STATES PATENT OFFICE

CERTIFICATE OF CORRECTION

Patent No. 4,091,965 Dated May 30, 1978

Inventor(s) Albert W. Gebhard

It is certified that error appears in the above-identified patent and that said Letters Patent are hereby corrected as shown below:

IN THE SPECIFICATION:

Column 2, line 4, cancel "through" and substitute -- thorough --.
Column 2, line 18, cancel "through" and substitute -- thorough --.

Column 5, line 63, cancel "0.50" and substitute -- 0.050 --.
Column 6, line 49, cancel "5" and substitute -- 15 --.

IN THE CLAIMS:

Claim 6, Column 8, line 10, cancel "ends" and substitute -- end --.
Claim 8, Column 8, line 57, cancel "enclosure".

Signed and Sealed this

*Second* Day of *October 1979*

[SEAL]

*Attest:*

RUTH C. MASON
*Attesting Officer*

LUTRELLE F. PARKER
*Acting Commissioner of Patents and Trademarks*